United States Patent [19]

Walton et al.

[11] Patent Number: 4,641,827

[45] Date of Patent: Feb. 10, 1987

[54] FABRIC PICKUP AND THE LIKE

[75] Inventors: Richard R. Walton, Ten West Hill Pl., Boston, Mass. 02114; George E. Munchbach, Roslindale, Mass.

[73] Assignee: Richard R. Walton, Boston, Mass.

[21] Appl. No.: 500,261

[22] Filed: Jun. 2, 1983

[51] Int. Cl.[4] ..... B65H 3/22

[52] U.S. Cl. ..... 271/18.3; 198/692; 271/92; 294/86.4; 414/908

[58] Field of Search ..... 271/18.3, 19–25, 271/105, 106, 92, 97, 98; 414/908; 198/692, 693; 294/86 R, 87.1

[56] References Cited

U.S. PATENT DOCUMENTS

| | | | |
|---|---|---|---|
| 793,009 | 6/1905 | Miller | 271/18.3 |
| 1,649,319 | 11/1927 | Molyneux | 464/58 |
| 1,780,195 | 11/1930 | Kinney | 271/18.3 |
| 2,837,333 | 6/1958 | Sindzinski et al. | 271/12 |
| 2,878,016 | 3/1959 | Russell et al. | 271/11 |
| 2,919,129 | 12/1959 | Sjostrom | 271/33 |
| 3,026,109 | 3/1962 | Pfeffer, Jr. | 271/32 |
| 3,064,968 | 11/1962 | Starnes | 271/19 |
| 3,083,961 | 4/1963 | Arbter | 271/33 |
| 3,168,308 | 2/1965 | Walton et al. | 271/27 |
| 3,176,979 | 4/1965 | Engelmann | 271/18 |
| 3,253,824 | 5/1966 | Southwell et al. | 271/19 |
| 3,291,480 | 12/1966 | Haddad | 271/1 |
| 3,353,821 | 11/1967 | Smith et al. | 271/16 |
| 3,355,165 | 11/1967 | Southwell et al. | |
| 3,369,803 | 2/1968 | Walton et al. | 271/10 |
| 3,386,396 | 6/1968 | Jacobs et al. | 112/2 |
| 3,386,763 | 6/1968 | Ottaway et al. | 294/61 |
| 3,406,961 | 10/1968 | Walton | 271/10 |
| 3,406,966 | 10/1968 | Walton | 271/68 |
| 3,430,949 | 3/1969 | Herdeg et al. | 271/63 |
| 3,442,505 | 5/1969 | Szentkuti | 271/1 |
| 3,531,103 | 9/1970 | Walton | 271/26 |
| 3,539,177 | 11/1970 | Schwenk et al. | 271/33 |
| 3,547,432 | 12/1970 | Herdeg | 271/20 |
| 3,550,932 | 12/1970 | Mason et al. | 271/26 |
| 3,583,341 | 6/1971 | Birdsong et al. | 112/121.29 |
| 3,583,695 | 6/1971 | Sherwood | 271/21 |
| 3,588,087 | 6/1971 | Rovin et al. | 270/58 |
| 3,588,091 | 6/1971 | Stone et al. | 271/19 |
| 3,588,092 | 6/1971 | Dubes | 271/19 |
| 3,593,991 | 7/1971 | Baron et al. | 271/70 |
| 3,625,506 | 12/1971 | Rovin | 271/18 |
| 3,632,106 | 1/1972 | Schwenk et al. | 271/68 |
| 3,670,674 | 6/1972 | Conner, Jr. | 112/121.29 |
| 3,672,314 | 6/1972 | Firestein et al. | 112/121.29 |
| 3,685,471 | 8/1972 | Reynolds | 112/121.29 |
| 3,704,884 | 12/1972 | Nicolay et al. | 271/85 |
| 3,710,953 | 1/1973 | Kirsch | 214/1 BS |
| 3,727,775 | 4/1973 | Beazley | 214/1 BC |
| 3,747,919 | 7/1973 | Stewart et al. | 271/19 |
| 3,756,587 | 9/1973 | Lutts et al. | 271/20 |
| 3,765,712 | 10/1973 | Hardy et al. | 294/87.1 |
| 3,806,114 | 4/1974 | Carter | 271/20 |
| 3,809,388 | 5/1974 | Downing | 271/20 |
| 3,813,094 | 5/1974 | Walton et al. | 271/19 |
| 3,902,750 | 9/1975 | Roitel | 294/88 |
| 3,981,495 | 9/1976 | Bijttebier | 271/18.3 |
| 4,239,205 | 12/1980 | Bourque | 271/175 |

FOREIGN PATENT DOCUMENTS

| | | |
|---|---|---|
| 1252515 | 12/1960 | France . |
| 2188578 | 1/1974 | France. |
| 1218433 | 1/1971 | United Kingdom. |

OTHER PUBLICATIONS

AAMA Apparel Research Journal, *Single-Ply Pick-Up Devices*, by John M. Murray, Dec. 1975, pp. 87–99.

USM Today, Oct., 1970, pp. 1–12.

*Primary Examiner*—Bruce H. Stoner, Jr.

*Assistant Examiner*—John A. Carroll

[57] ABSTRACT

A fabric component pickup apparatus or the like having first and second fabric gripping elements defining first and second opposed gripping lines in the plane of the face of the fabric component, the fabric gripping elements adapted for movement relative to each other essentially in the plane with simultaneous components of motion closing the distance between the gripping lines and displacing one gripping line laterally in the plane of the fabric at an angle to the closing motion. As the fabric lying between gripping lines is tensioned by the component of lateral displacement motion of the gripping elements, the fabric is simultaneously gathered by the component of closing motion. In one preferred embodiment, an air blast is directed through the porosity created by tensioning the fabric to impinge upon the underlying layer of fabric.

17 Claims, 33 Drawing Figures

Figure 5:
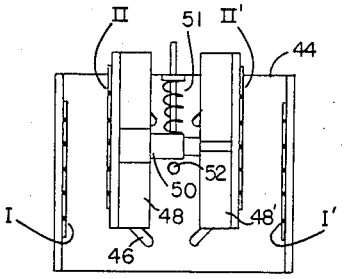

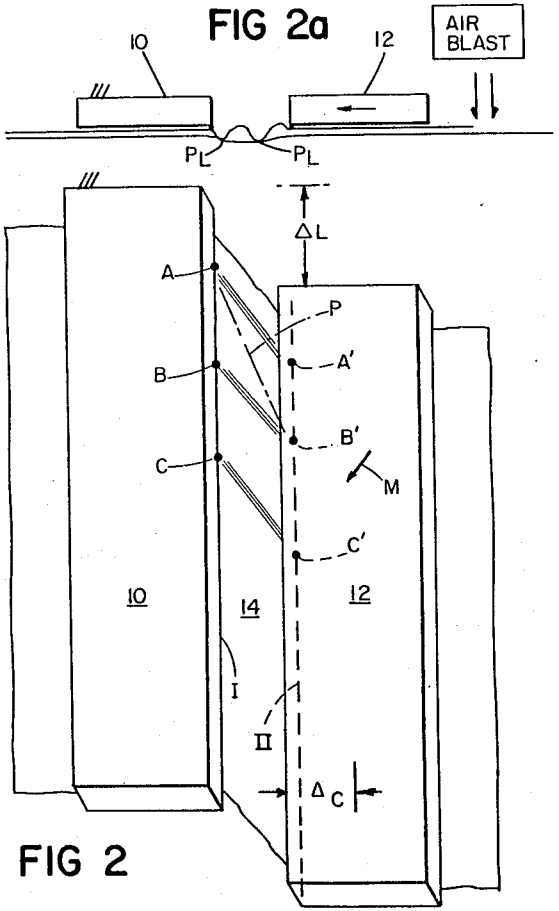
FIG 2a
FIG 2
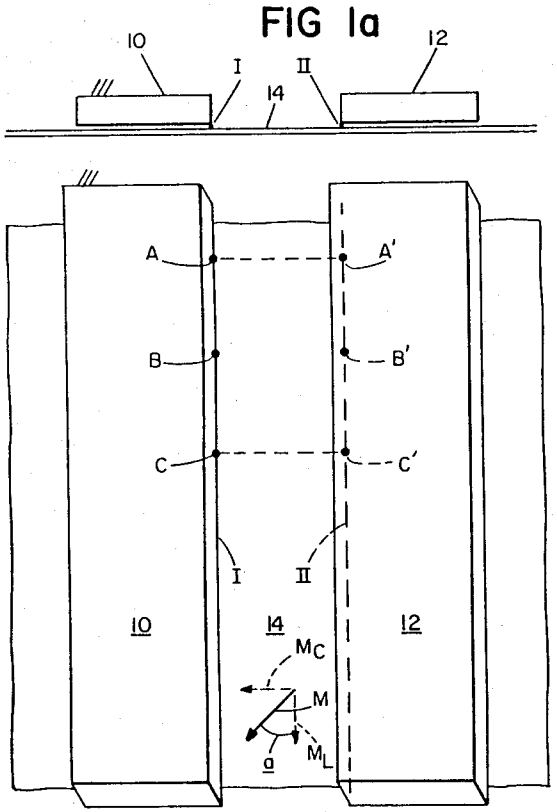
FIG 1a
FIG 1

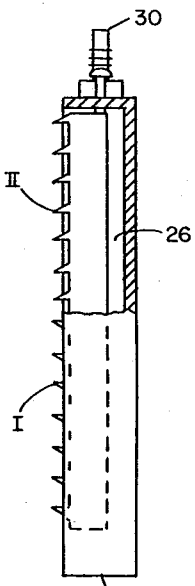
FIG 4a
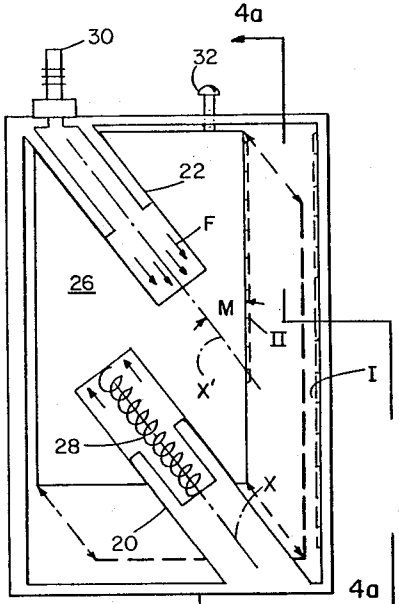
FIG 4
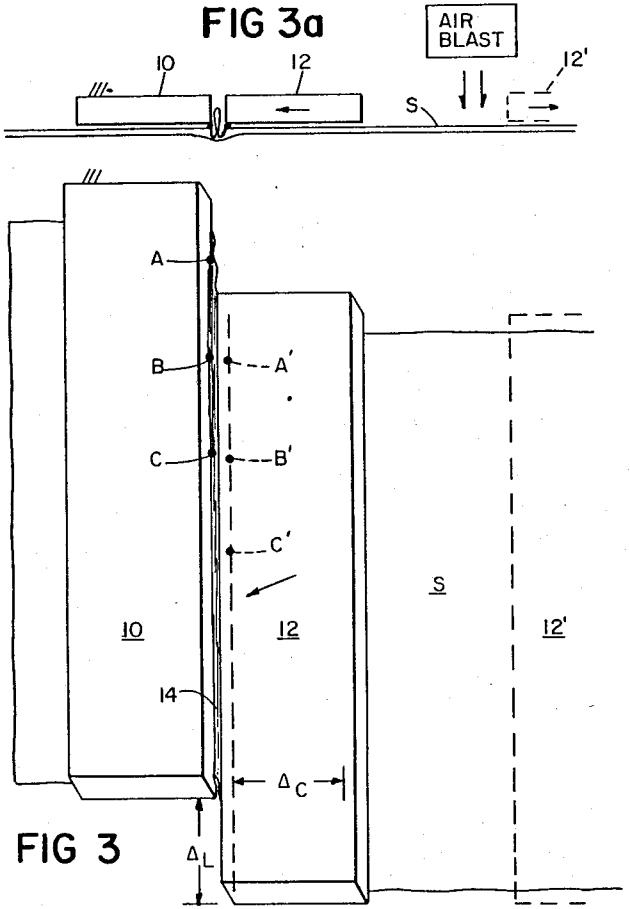
FIG 3a
FIG 3

FIG 12
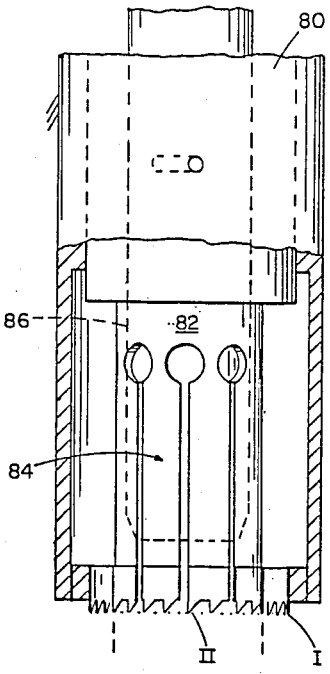
FIG 13
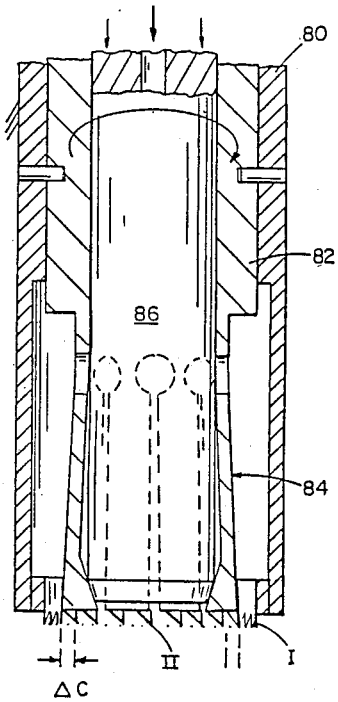
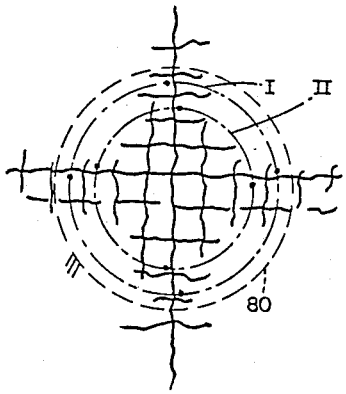
FIG 12a
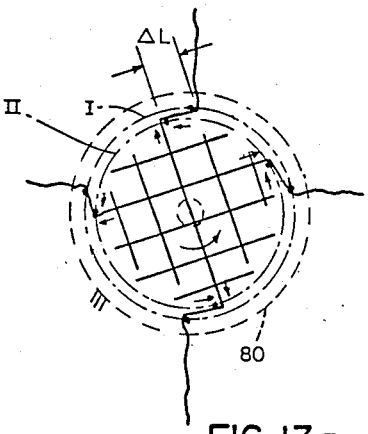
FIG 13a

FABRIC PICKUP AND THE LIKE

BACKGROUND

This invention provides a key step in the automation of the garment industry by the elimination of the need for manual separation of individual fabric layers from a stack. The invention has particular application where the nature of the fabric may be different from one layer to the next.

For many decades the step of manual separation has been a chief obstacle to automated manufacture of garments. It has long been possible to efficiently form a stack of identically shaped components for a garment by simultaneous cutting with a fabric saw through a multiplicity of overlying layers, guided by a pattern. Likewise, accurate sewing together of the various components has been efficiently accomplished as by use of automated platens and high speed sewing machines. The possibilities of computer control in recent years has increased the speed of these techniques that have long been quite fast.

But between the steps of forming the stack, and sewing together the individual pieces, has remained the tedious manual step of separating an individual component from a stack of the components. The intertangling of threads at the cut edges of adjacent pieces, the limpness of the pieces, the variation in texture, and other parameters, from piece to piece, have together made the separation problem one of the chief obstacles to elimination of the slowness and expense of manual labor in the garment industry.

Our own work on this problem for more than a quarter of a century, as well as the work of numerous others, is testimony to the difficulties of the problem. Although we, and others, have been able to find ways to separate like pieces, and to show promising progress even with dissimilar pieces, the proposed solutions of the past work of ourselves and others have not been found acceptable by the industry.

Our prior designs are shown in U.S. Pat. Nos.:

| | | |
|---|---|---|
| 3,168,307 | Walton et al | 1962 |
| 3,369,803 | Walton et al | 1968 |
| 3,406,961 | Walton | 1968 |
| 3,406,966 | Walton | 1968 |
| 3,813,094 | Walton et al | 1974 |

Examples of the work of others in the same or somewhat related fields are:

| | | |
|---|---|---|
| 793,009 | Miller | 1903 |
| 1,649,319 | Molyneux | 1927 |
| 1,780,195 | Kinney | 1930 |
| 3,026,109 | Pfeffer | 1962 |
| 3,176,979 | Engelmann | 1965 |
| 3,291,480 | Haddad | 1966 |
| 3,253,824 | Southwell et al | 1966 |
| 3,353,821 | Smith et al | 1967 |
| 3,386,396 | Jacobs et al | |
| 3,386,763 | Ottaway et al | 1968 |
| 3,442,505 | Szentkuti | 1969 |
| 3,547,432 | Herdeg | 1970 |
| 3,550,932 | Mason | 1970 |
| 3,583,695 | Sherwood | 1971 |
| 3,588,091 | Stone et al | 1971 |
| 3,625,506 | Rosin | 1971 |
| 3,747,919 | Stewart et al. | 1973 |
| 3,756,587 | Lutts et al. | 1973 |

-continued

| | | |
|---|---|---|
| 3,806,114 | Carter | 1974 |

This corpus of work represents an extensive, long term, diligent effort at use of needles and other gripping materials, tensioning and nipping motions, and air and vacuum assists, etc., aimed at this seemingly simple problem. Yet, the garment industry continues to move to those places in the world where manual labor can be afforded at lowest cost, one major reason being the need, as still recognized, to use hand dexterity, for picking up and performing related operations on individual fabric pieces or separating the pieces of fabric individually from the stack.

SUMMARY OF THE INVENTION

According to the invention, a fabric component pickup apparatus or the like comprises, first and second fabric gripping elements defining first and second opposed gripping lines in the plane of the face of the fabric component and means for producing relative movement of the fabric gripping elements essentially in the plane with simultaneous components of motion closing the distance between the gripping lines and displacing one gripping line laterally in the plane of the fabric at an angle to the closing motion, whereby, as the fabric lying between gripping lines is tensioned by the component of lateral displacement motion of the gripping elements, the fabric is simultaneously gathered by the component of closing motion.

In preferred embodiments, the fabric gripping lines defined by the elements are essentially straight lines, and the means for producing the motion is adapted to bring the gripping elements essentially together to nip the gathered area of fabric in an essentially straight line on the face of the fabric, in the manner that the fabric between the gripping elements is gathered in the form of a series of diagonal, tensioned folds, preferably the apparatus comprises two pairs of gripping elements spaced from one another, the inside gripping elements of each pair being movable away from each other in their motion toward the second pair in the manner that, as the fabric is gathered between the operating pairs, the fabric lying between the two inner members is tensioned, more preferably the apparatus includes means for directing a blast of air through the tensioned portion of the fabric lying between inner gripping elements during motion, the tension produced by separating motion of the inner elements serving to stretch open the pores of the fabric to allow the blast of air to pass freely through the first layer and press the layer below the first layer away from the first layer, preferably the means for producing the air blast is effective to produce the air blast during the closing motion of the two pairs of elements together; in any of these embodiments one gripping element is fixed and supported by a frame, and the other of element is movably supported by the frame, preferably the movable element is slidably mounted on guide rods defining the motion with the two components, more preferably the fixed frame defines guide slots in which the movable component is engaged for defining motion, or the movable element is supported on pivotal links to the fixed element, or, including in the form of two pairs of elements, the fixed frame defines outer elements of the pairs, the movable elements lying within the frame and having an air piston disposed therebetween, expansion of the piston and cylinder arrangement effective to simultaneously spread the inner elements apart towards their respective fixed elements; the gripping lines are concentric circular lines, one of the lines being defined by a flexible member, and means for enabling the flexible member to deflect gradually during circular motion whereby the elements close together while being displaced laterally; and the relative motion between fabric gripping elements occurs at a displacement of angle between about 20° and 45°, measured between the relative positions of opposed points on the first and second gripping lines before and after said relative movement.

According to another aspect of the invention, a fabric component pickup apparatus or the like for removing a single component from a stack of components comprises means for applying tension to a first fabric component on the top of the layered stack, and means for directing a flow of air against and through the tensioned surface of the first fabric component, whereby the application of tension to the first component increases the open area of the component for flow of the air therethrough, the air thereby impinging upon the surface of the next underlying component to facilitate separation of the first component from the remainder of the stack.

In preferred embodiments of this aspect of the invention, the means for applying tension comprises spaced apart fabric gripping elements, and means for producing relative movement between the elements to apply tension to the fabric; preferably the means for producing relative movement of the fabric gripping elements is constructed and adapted to produce simultaneous components of motion, whereby, the fabric lying between the gripping elements is tensioned by a lateral displacement motion of the gripping elements and the fabric is simultaneously gathered in a closing motion.

We turn now to the structure and manufacture of the preferred embodiment, first briefly describing the drawings.

DRAWINGS

Figure 5A:
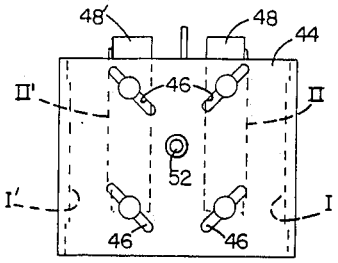
Figure 6:
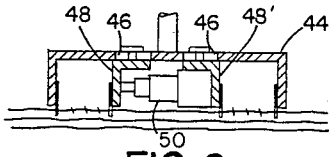
Figure 6A:
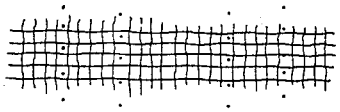
Figure 7:
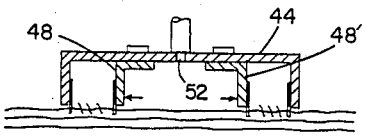
Figure 7A:
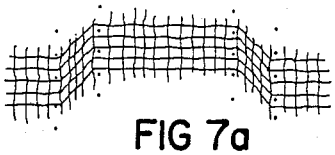
Figure 10A:
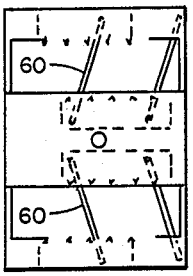
Figure 10:
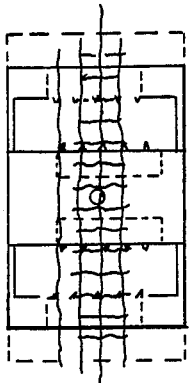
Figure 10B:
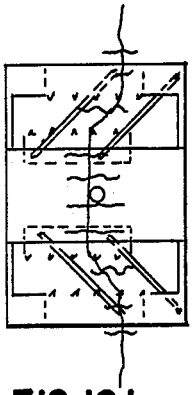
Figure 10C:
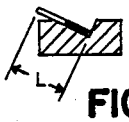
Figure 10D:
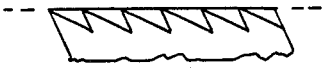
Figure 11A:
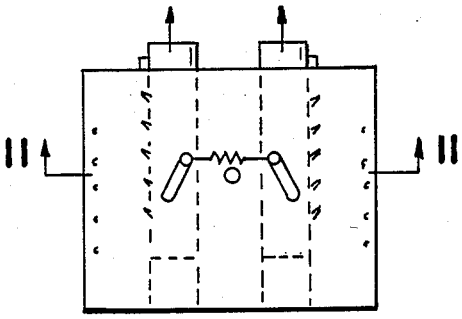
Figure 11:
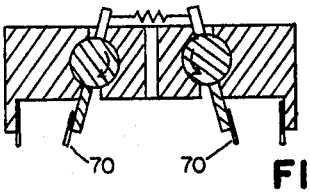
Figure 15:
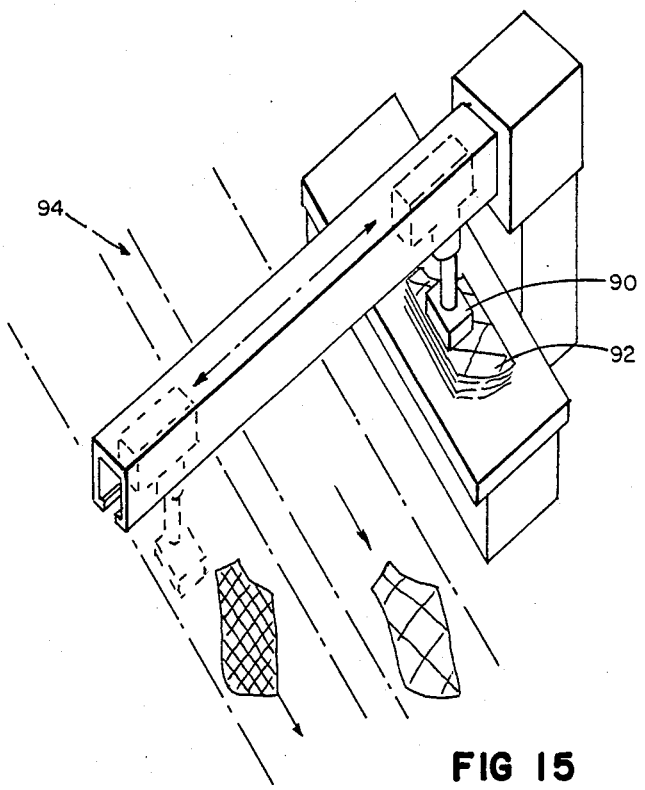
Figure 14:
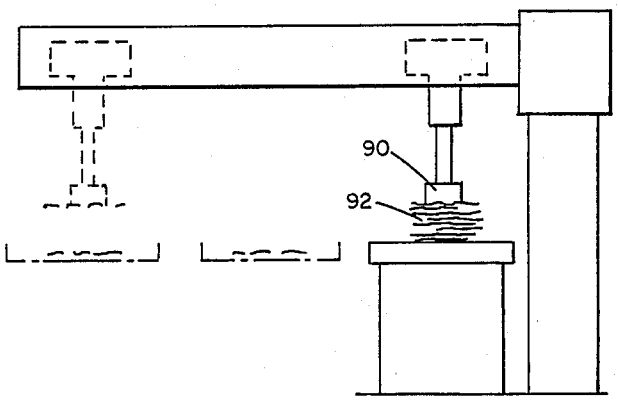

FIGS. 1, 1*a*, 2, 2*a* and 3, 3*a* comprise three successive illustrative sets of views of gripping elements according to the invention at successive stages of position during their action;

FIG. 4 is a top view of a preferred construction in which the movable element slides on stationary guides which are angled relative to the line of the stationary element;

FIG. 4*a* is a cross-sectional view illustrating the direction of the card clothing teeth of the cloth-gripping elements of the embodiment of FIG. 4;

FIGS. 5 and 5*a* are bottom and top views respectively of another preferred embodiment employing two sets of linear gripping elements, the inner elements of the two sets being adapted to move apart from one another;

FIGS. 6, 6*a*; FIGS. 7, 7*a*; FIGS. 8, 8*a* and FIGS. 9, 9*a* are sets of views illustrating the action of the pickup device of FIG. 5;

FIG. 10 is a top view of another preferred embodiment employing pivoted links for supporting the movable elements while FIGS. 10*a* and 10*b* show the apparatus at various stages of position during this operation;

FIG. 10*c* is a cross section and FIG. 10*d* is a perspective view illustrating the teeth employed in the apparatus of FIG. 10, for acting upon fine materials such as fine silk;

FIGS. 11 and 11*a* illustrate another possible configuration of the apparatus employing a rotational motion for achieving the closing and diagonal displacement of one elongated element relative to the other;

FIGS. 12, 12*a* and 13, 13*a* are sets of figures doing the operation of another embodiment in which the gripping elements are disposed on curved lines;

FIG. 14 is a side view; and FIG. 15 a perspective view of an apparatus employing a pickup apparatus according to the invention.

Figure 16A:
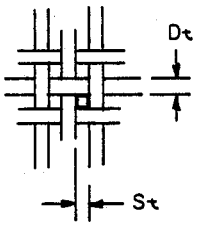

FIGS. 16 and 16*a* show the relative porosity of untensioned and tensioned fabric, respectively.

PREFERRED EMBODIMENT

Referring now to FIGS. 1, 1*a*, FIGS. 2, 2*a*, and FIGS. 3, 3*a*; straight fabric gripping lines I and II are defined by stationary and movable members 10 and 12, respectively. Gripping lines I and II lie in the plane of fabric piece 14 and are defined for instance by card clothing points arranged vertically, see FIG. 1*a*, with the angle of the points sloping in different directions for the two respective gripping lines. Means not shown are arranged to permit the simultaneous motion M with closing component $M_C$ and lateral displacement component $M_L$.

In the initial position of FIG. 1, the two gripping lines I and II are parallel and arbitrary points are selected along the two elements which are directly opposed to each other, pairs of points A, A′, B, B′ and C, C′. FIG. 2 shows an intermediate position of the movable gripping line in which displacement $\Delta_L$ has occurred in the direction parallel to the lines and the elements have been closed together by an amount $\Delta_C$. In this position it is seen that points A′, B′ and C′ have been displaced diagonally, relative to their mating points. At the same time the rectangle of cloth bounded in FIG. 1 by points A, A′, C′ and C has now been distorted to a diagonal shape, with less area, cloth therefore assuming a corrugated or pleated condition, as depicted by dashed line P in FIG. 2*a* at an angle less than that formed by points A′, A. The cloth is under significant tension as a result of the lateral displacement $\Delta_L$ of the movable cloth gripping element. The motion shown in FIGS. 2 and 3 are in the nature of the motion of a parallelogram for illustrative purposes. The particular angle of motion chosen, whether it is variable or constant throughout the range of motion, is dependent upon the particular fabric at hand. For instance, in the case of knitted fabrics having considerable elongation, the displacement angle a, as shown in FIG. 1, may be quite acute, down to about 20°, with significantly large increment of lateral displacement for a given increment of closing displacement. On the other hand, with fabrics having little elongation, tightly woven fabrics for instance, the angle a may be significantly larger, up to about 45°. Also, while it is presently preferred that mechanical means define the degree of motion throughout its range, in certain circumstances it is possible for the fabric itself to be employed to define the motion, for instance, it is possible to sense the tension being applied between the movable and fixed gripping elements, and to vary the ratio of lateral to closing displacement, during closing motion, to maintain a fixed degree of tension.

Progressing from the position of FIG. 2 to FIG. 3, the pleated material is nipped between the closed elements. The net result of the action depicted in FIGS. 1–3 is to effect a positive grip on the top fabric component in a stack, while creating conditions that decrease the tendency for the second largest fabric to follow the first. Much of the problem in the separation of the top component from a stack without disturbing the second component arises from fiber engagement between the two pieces. However, when the top piece is placed under significant tension, its frictional engagement with the second component is decreased and more readily slides over the face of the stack without disturbing the stack. Furthermore, there is somewhat of a wedging action experienced in the nip between the two components. Due to the accumulation of the first piece, the accumulated material tends to press downwardly and to exclude the second piece.

Figure 16B:
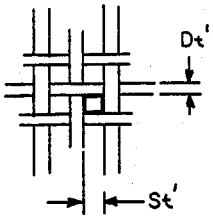

The condition of FIG. 3 is normally reached before the top component is taken away. To enhance the operation just described, a blast of air can advantageously be employed. In a preferred form of the invention, two sets of the separating elements are employed as suggested in FIG. 3. The inner element 12' of the second pair moves away from the inner element 12 of the first pair to put the intervening span S as shown in FIG. 3*a* under tension. Referring to FIGS. 16*a* and 16*b*, the effect of this tensioning is shown. In the untensioned state (FIG. 16*a*), the threads in both direction have equal spacing $S_t$ and the thread diameters $D_t$ are equal. A typical open area between the threads, (darkened in the figures for clearer reference) is relatively small, with little or no porosity. When tension is applied, as indicated by the arrows in FIG. 16*a*, the diameter $D'_t$ of the threads lying parallel to the direction of the tensioning force is reduced; and the spacing $S'_t$ between thread perpendicular to the force is increased. The open area, again darkened, and hence the porosity of the fabric, is increased. An air blast, directed at the surface of the relatively porous top tensioned fabric, passes readily through and press on the surface of the untensioned underlying layer which therefore presents a relatively large frontal area to receive the air blast. This creates a relatively high static pressure condition. The effect is to press the second layer against the stack, increasing its frictional engagement with the third layer, thus unifying the remainder of the stack and further decreasing the possibilities of disturbing the stack during the removal operation. It is to be noted that this air blast can be applied soon after the closing motion of elements 12 and 12' begins, and continues during the closing motion until the condition of FIG. 3 is reached.

FIG. 4 represents the presently preferred construction of a pickup element. Stationary guide tubes 20 and 22, set at an angle M, are permanently secured to fixed frame 24. Fixed frame 24 defines stationary linear fabric-gripping element I. A block 26 having holes receiving the stationary tubular guides 20 and 22 is slidably mounted to reciprocate between the solid line position and dotted line positions shown and carries fabric gripping element II. A compression spring 28 urges the block 26 to the solid line open position while an air inlet 30 permits the selective application of compressed air through tube 22. Stop 32 adjustably establishes the initial open position of block 26. When the compressed air is applied, forces F urge body 26 to slide along parallel axes X and X' to simultaneously close and displace laterally fabric gripping element II relative to the fixed element I. As shown in FIG. 4*a*, the two cloth fabric-gripping elements I and II are comprised of card clothing whose inclination of teeth are set in opposite directions to one another. This has the effect that during displacement in the direction of force F, the card clothing can positively grip the cloth, but by opposite motion of the block, the component is released, e.g. to drop it on a conveyer. In this case the points of the card clothing can be arranged vertically as suggested by FIG. 4*a*, with distance of protrusion from their support in the range of about 0.005 inch to 0.010 inch, depending upon the general types of fabric being employed. For more delicate fabrics, where no penetration is desired, other arrangements are possible. For instance, referring to FIGS. 10*c* and 10*d*, the card clothing may have only the top corners of its teeth exposed in a nonpenetrating form, e.g. for use with fine silks, or other fabric-gripping elements, including abrasive-like materials can be employed.

In a further preferred embodiment shown in FIG. 5, a stationary frame 44 defines stationary fabric-gripping lines I and I'. Slotted guides 46 are provided in the stationary frame and serve to guide moving elements 48 and 48'. An air piston arrangement 50 is disposed between the two elements, enabling simultaneous motion of the two along their respective guides while a compression spring 51 serves to return the movable elements to their open position upon the termination of the application of compressed air to the unit.

Figure 8:
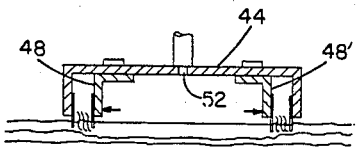
Figure 8A:
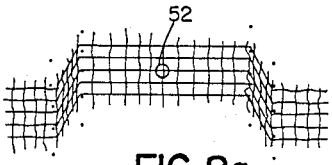
Figure 9:
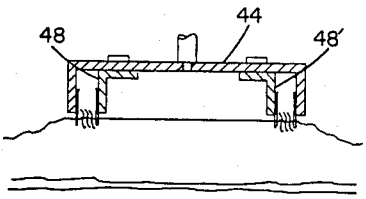
Figure 9A:
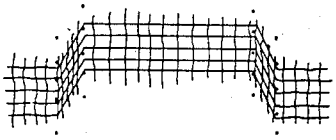

FIGS. 6–8 show the sequence of operation of the embodiment of FIG. 5. In FIG. 6, the fabric gripping lines are engaged upon the top piece of fabric in the stack. FIG. 6*a* shows (representatively) the fabric with the points of engagement. Moving to FIG. 7, air piston arrangement 50 has been activated to move elements 48, 48' toward lines I, I', respectively as indicated by the arrows. As shown in FIG. 7*a* and further in FIG. 8*a*, this action stretches the center section of the fabric between elements 48, 48', increasing the open space, i.e. porosity, of the fabric. An air blast from nozzle 52 passes through the stretched fabric to impinge upon the surface of the underlying sheet to hold it in place as the gripped top sheet is removed. In FIG. 8, the movable and stationary elements have gripped the sheet and in FIG. 9, the sheet is lifted separately from the stack.

Referring now to FIGS. 10, 10*a* and 10*b*, in this embodiment pivotal links 60 define the motion of the elements, as suggested in FIGS. 1–3.

In the embodiment of FIG. 11*a*, the inner movable element 70 are mounted to rotate close to a top dead-center arrangement so that the change in elevation is very slight during the rotation. The axial movement of the elements is achieved by the cam guide slots provided in the stationary frame.

In the embodiment of FIGS. 12 and 13 the fabric gripping lines are circular in nature, provided by concentric cylinders 80, 82. The inner cylinder is slotted at spaced intervals to form spring arms 84 that are capable of radial deflection. In some instances, where the thickness of the tube and frequency of the slots is sufficient, the elements can respond to the tension of the cloth to deflect outwardly into a cloth-nipping position. In other elements a positive camming member, for instance the camming rod 86, as shown in the figures, is employed. In the retracted position (FIG. 12) the camming rod 86 applies no force to the inner member, and the inner member is cylindrical and significantly spaced from the outer member. When the camming rod 86 is displaced downwardly to a position shown in FIG. 13, it forces the spring fingers outwardly by a distance $\Delta C$ to the nipping position. This motion is accompanied by rotational motion of the inner member by a distance $\Delta_L$ so that both the closing component of motion $M_c$ and the displacement component of motion $M_L$ occurs. The fabric is displaced in the way shown diagrammatically in FIGS. 12*a* and 13*a* to effect results similar to those previously described. An air jet may be directed upon the tensioned fabric lying within the circle of the inner element, as suggested in the figure.

Referring to FIGS. 14 and 15, after the closing motion is completed as depicted in FIG. 3, with the entire rectangular area bounded by A, A', C' and C, FIG. 1, compressed into the very small area represented by A, A', C', C in FIG. 3, then the pickup device 90 may be lifted or the stack 92 may be dropped, to remove the top component from the stack. Then the apparatus may be moved to deposit the component, e.g. on the conveyer 94 as shown in FIGS. 14 and 15 or into a slot or other receptacle or platen, to enable automated formation of the garment without the pieces being ever touched manually from the stack to the finished garment.

In another embodiment (not shown), two stationary linear elements may be defined by the fixed frame at a converging angle, with the block defining the corresponding movable elements constructed to move in a manner to bisect the angle formed by the stationary elements.

We claim:

1. A fabric component pickup apparatus or the like comprising, first and second fabric gripping elements defining first and second opposed gripping lines in the plane of the face of the fabric component, and means for producing relative movement of said fabric gripping elements when in contact with the face of a said fabric component with motion to displace one of said gripping lines laterally in the plane of the fabric in the manner to produce tension in the fabric and with motion effective to close said fabric gripping elements together after said tension has been applied to said fabric to grip the fabric therebetween.

2. The fabric component pickup apparatus of claim 1 wherein said fabric gripping lines defined by said elements are essentially straight lines, and said means for producing said relative movement is adapted to bring said gripping elements essentially together to nip the gathered area of fabric in an essentially straight line on the face of the fabric, in the manner that the fabric between said gripping elements is gathered in the form of a series of diagonal, tensioned folds.

3. The apparatus of claim 1 wherein said gripping lines are concentric circular lines, one of said lines being defined by a flexible member, and means for enabling said flexible member to deflect gradually during circular motion whereby said elements close together while being displaced laterally.

4. The apparatus of claim 1 wherein the relative movement between said fabric gripping elements occurs at a displacement angle between about 20° and 45°, measured between the relative positions of opposed points on the first and second gripping lines before and after said relative movement.

5. The apparatus of claim 1 or 2 wherein one of said gripping elements is fixed and supported by a frame, and the other of said elements is movably supported by said frame.

6. The apparatus of claim 5 wherein said movable element is slidably mounted on guide tubes defining said relative movement.

7. The apparatus of claim 6 wherein said frame defines guide slots in which said movable component is engaged for defining said motion.

8. The apparatus of claim 6 wherein said movable element is supported on pivotal links to said fixed element.

9. The apparatus of claim 6 including in the form of two pairs of said elements, the fixed frame defining outer elements of said pairs, the movable elements lying within said frame and having an air piston disposed therebetween, expansion of said piston and cylinder arrangement effective to simultaneously spread said inner elements apart towards their respective fixed elements.

10. A fabric component pickup apparatus or the like comprising, two pairs of first and second fabric gripping elements spaced from one another, each said pair of elements defining first and second opposed gripping lines in the plane of the face of the fabric component, said fabric gripping lines defined by said elements being essentially straight lines, and means for producing relative movement of said fabric gripping elements in each said pair essentially in said plane, with simultaneous components of motion closing the distance between said gripping lines in each said pair laterally in the plane of the fabric at an angle to said closing motion in the manner that, as the fabric lying between said gripping lines is tensioned by said component of lateral displacement motion of said gripping elements, said fabric is simultaneously gathered by said component of closing motion, said means for producing said relative movement being further adapted to bring said gripping elements in each pair essentially together to nip the gathered area of fabric in an essentially straight line on the face of the fabric, in the manner that the fabric between said gripping element is gathered in the form of a series of diagonal, tensioned folds, and the inside gripping elements of each of said pairs also being movable away from each other in their motion toward the second of each of said pairs in the manner that, as the fabric is gathered between the operating pairs, the fabric lying between the two inside members is tensioned.

11. The fabric component pickup apparatus of claim 10 including means for directing a blast of air through the tensioned portion of the fabric lying between said inside gripping elements during said motion, the tension produced by said motion of said inside elements away from each other serving to stretch open the pores of said fabric to allow the blast of air to pass freely through a first layer and press the layer below the first layer away from the first layer.

12. The apparatus of claim 11 wherein means for directing said air blast is effective to produce said air blast during the closing motion of said two pairs of elements together.

13. The apparatus of claim 10, 11, or 12 wherein one of said gripping elements is fixed and supported by a frame, and the other of said elements is movably supported by said frame.

14. The apparatus of claim 13 wherein said movable element is slidably mounted on a guide tube defining said motion with said two components.

15. The apparatus of claim 14 wherein said fixed frame defines guide slots in which said movable component is engaged for defining said motion.

16. The apparatus of claim 14 wherein said movable element is supported on pivotal links to said fixed element.

17. The apparatus of claim 14 wherein the fixed frame defines outer elements of said pairs, and the movable elements lie within said frame and have an air piston disposed therebetween, expansion of said piston and cylinder arrangement being effective to simultaneously spread said inner elements apart towards their respective fixed elements.

* * * * *